US008100097B2

(12) United States Patent
Takahashi et al.

(10) Patent No.: US 8,100,097 B2
(45) Date of Patent: Jan. 24, 2012

(54) MULTI-LINK ENGINE

(75) Inventors: Naoki Takahashi, Yokohama (JP); Masayuki Tomita, Fujisawa (JP); Kenshi Ushijima, Kamakura (JP); Koji Hiraya, Yokohama (JP); Hirofumi Tsuchida, Yokosuka (JP); Shunichi Aoyama, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 672 days.

(21) Appl. No.: 12/255,336

(22) Filed: Oct. 21, 2008

(65) Prior Publication Data

US 2009/0107452 A1 Apr. 30, 2009

(30) Foreign Application Priority Data

Oct. 26, 2007 (JP) ..... 2007-279395
Oct. 26, 2007 (JP) ..... 2007-279401
Oct. 30, 2007 (JP) ..... 2007-281459
Jun. 20, 2008 (JP) ..... 2008-161633

(51) Int. Cl.
*F02B 75/04* (2006.01)

(52) U.S. Cl. ..... 123/48 R; 123/78 R; 123/48 AA

(58) Field of Classification Search ..... 123/48 R, 123/48 AA, 48 B, 78 R, 78 B, 78 BA, 78 E, 123/78 F
See application file for complete search history.

(56) References Cited

U.S. PATENT DOCUMENTS 3,693,463 A * 9/1972 Garman ..... 74/38
4,732,115 A * 3/1988 Lapeyre ..... 123/51 B
5,680,840 A * 10/1997 Mandella ..... 123/197.4
6,390,035 B2 * 5/2002 Moteki et al. ..... 123/78 BA
6,505,582 B2 * 1/2003 Moteki et al. ..... 123/48 B
6,561,142 B2 * 5/2003 Moteki et al. ..... 123/48 B
6,622,670 B2 * 9/2003 Hiyoshi et al. ..... 123/48 B
6,684,828 B2 * 2/2004 Ushijima et al. ..... 123/48 B
6,792,924 B2 * 9/2004 Aoyama et al. ..... 123/568.14
7,290,508 B2 11/2007 Mizuno et al.

(Continued)

FOREIGN PATENT DOCUMENTS

CN 1987069 A 6/2007
JP 2001-227367 A 8/2001
JP 2002-061501 A 2/2002

(Continued)

OTHER PUBLICATIONS

An English translation of the Chinese Office Action of corresponding Chinese Application No. 200810173230.2, dated Mar. 16, 2010.

*Primary Examiner* — Noah Kamen
*Assistant Examiner* — Long T Tran
(74) *Attorney, Agent, or Firm* — Global IP Counselors, LLP

(57) ABSTRACT

A multi-link engine has a piston coupled to a crankshaft to move inside an engine cylinder. A piston pin connects the piston to an upper link, which is connected to a lower link by an upper link pin. A crank pin of the crankshaft rotatably supports the lower link thereon. A control link pin connects the lower link to one end of a control link, which is connected at another end to the engine block body by a control shaft. The crank pin has a center arranged on a straight line joining centers of the upper link pin and the control link pin such that an angle formed between the straight line and a horizontal axis that is perpendicular to a center axis of the cylinder and that passes through an axial center of a crank journal is the same for at top dead center and at bottom dead center.

8 Claims, 11 Drawing Sheets

U.S. PATENT DOCUMENTS

| | | | | |
|---|---|---|---|---|
| 7,363,902 | B2 | 4/2008 | Ushijima et al. | |
| 2001/0017112 | A1* | 8/2001 | Moteki et al. | 123/78 R |
| 2002/0144665 | A1* | 10/2002 | Ushijima et al. | 123/48 B |
| 2003/0209213 | A1* | 11/2003 | Moteki et al. | 123/48 B |

FOREIGN PATENT DOCUMENTS

| | | | |
|---|---|---|---|
| JP | 2005-147068 | A | 6/2005 |
| JP | 2005-163740 | A | 6/2005 |
| JP | 2006-183595 | A | 7/2006 |

* cited by examiner

UPWARD TRIANGLE

DOWNWARD TRIANGLE

LINEAR TYPE

MULTI-LINK ENGINE

CROSS-REFERENCE TO RELATED APPLICATIONS

This application claims priority to Japanese Patent Application Nos. 2007-279395, filed on Oct. 26, 2007, 2007-279401, filed on Oct. 26, 2007, 2007-281459, filed on Oct. 30, 2007, and 2008-161633, filed on Jun. 20, 2008. The entire disclosures of Japanese Patent Application Nos. 2007-279395, 2007-279401, 2007-281459 and 2008-161633 are hereby incorporated herein by reference.

BACKGROUND OF THE INVENTION

1. Field of the Invention

The present invention generally relates to a multi-link engine. More specifically, the present invention relates to a link geometry for a multi-link engine.

2. Background Information

Engines have been developed in which a piston pin and a crank pin are connected by a plurality of links (such engines are hereinafter called multi-link engines). For example, a multi-link engine is disclosed in Japanese Laid-Open Patent Publication No. 2002-61501. A multi-link engine is provided with an upper link, a lower link and a control link. The upper link is connected to a piston, which moves reciprocally inside a cylinder by a piston pin. The lower link is rotatably attached to a crank pin of a crankshaft and connected to the upper link with an upper link pin. The control link is connected to the lower link with a control link pin for rocking about a control shaft pin.

An engine in which the piston and crankshaft are connected by single-link (i.e., a connecting rod) is a common engine that is referred to hereinafter as a "single-link engine" in contrast to a multi-link engine. A distinctive characteristic of a multi-link engine is that it enables a long stroke to be obtained without increasing the top deck height (overall height), which is not possible in an engine having one link (i.e., connecting rod) connected between the piston and the crank shaft (an engine with one link is a normal engine but hereinafter will be referred to as a "single-link engine"). Technologies utilizing this characteristic are being proposed, such as in Japanese Laid-Open Patent Publication No. 2006-183595.

In Japanese Laid-Open Patent Application No. 2006-183595, a sliding part of a piston (piston skirt) is formed with a minimal amount that is necessary. Additionally, cylinder liner of the cylinder block is provided with a cutout such that a counterweight of the crankshaft and a link component can pass through the cutout of the cylinder liner. In this way, the position of a bottom end of the cylinder liner and the bottom dead center position of the piston can be lowered and a longer stroke can be achieved without increasing the overall height of the engine. Other related patent documents include Japanese Laid-Open Patent Publication No. 2001-227367 and Japanese Laid-Open Patent Publication No. 2005-147068

In view of the above, it will be apparent to those skilled in the art from this disclosure that there exists a need for an improved multi-link engine. This invention addresses this need in the art as well as other needs, which will become apparent to those skilled in the art from this disclosure.

SUMMARY OF THE INVENTION

It has been discovered that when a cutout is formed in the bottom end of the cylinder liner as described above, the rigidity of the cylinder liner is weakened in the vicinity of the cutout. Meanwhile, the surface pressure applied to the cylinder liner is higher in the vicinity of the cutout because the surface area of the cylinder liner is smaller in the vicinity of the cutout. Consequently, there is the possibility that the cylinder liner will undergo deformation or the contact state between the cylinder liner and the piston skirt will be degraded when the piston experiences a large thrust load. Also, when the piston experiences a large thrust load, there is the possibility that an edge of the cutout of the cylinder liner will cause a film of lubricating oil on the piston skirt to be scraped off.

The present invention was conceived in view of these problems. Object is to provide a link geometry for a multi-link engine that prevents deformation of the cylinder liner from occurring even when the rigidity of the cylinder liner has been weakened by removing a portion of the bottom end of the cylinder liner.

In view of the above, a multi-link engine is provided that basically comprises an engine block body, a crankshaft, a piston, an upper link, a lower link and a control link. The engine block body includes at least one cylinder. The crankshaft includes a crank pin. The piston is operatively coupled to the crankshaft to reciprocally move inside the cylinder of the engine. The upper link is rotatably connected to the piston by a piston pin. The lower link is rotatably connected to the crank pin of the crankshaft and is rotatably connected to the upper link by an upper link pin. The control link is rotatably connected at one end to the lower link by a control link pin and rotatably connected at another end to the engine block body by a control shaft. The crank pin of the crankshaft has a center arranged on an imaginary straight line joining centers of the upper link pin and the control link pin such that an angle formed between the imaginary straight line and a horizontal axis that is perpendicular to a center axis of the cylinder and that passes through an axial center of a crank journal of the crankshaft is the same when the piston is at top dead center as when the piston is at bottom dead center.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
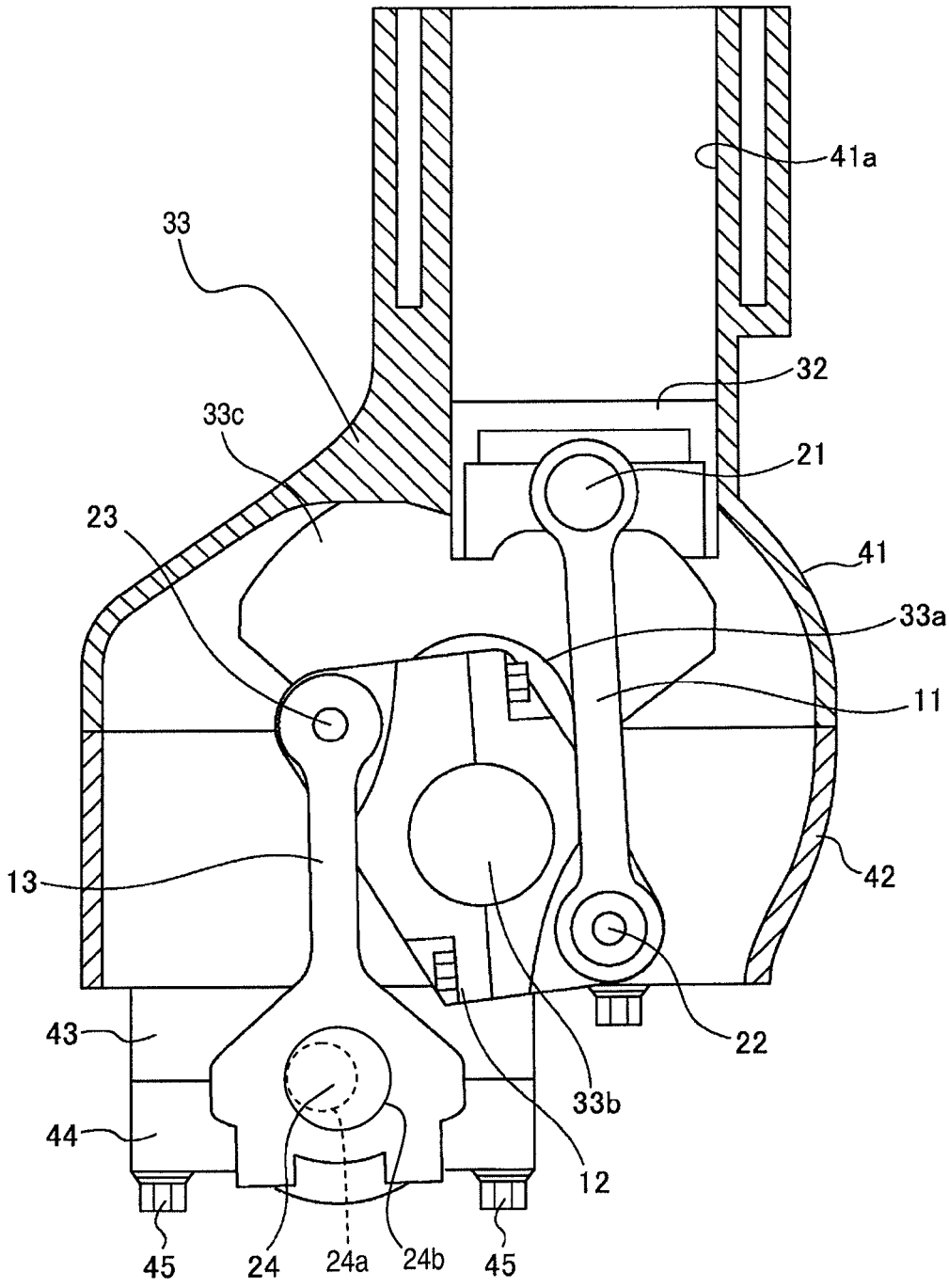
FIG. 1 is a vertical cross sectional view of a multi-link engine in accordance with one embodiment.

Referring initially to FIG. 1, selected portions of a multi-link engine 10 is illustrated in accordance with a preferred embodiment. The multi-link engine 10 has a plurality of cylinder. However, only one cylinder will be illustrated herein for the sake of brevity. The multi-link engine 10 includes, among other things, a linkage for each cylinder having an upper link 11, a lower link 12 connected to the upper link 11 and a control link 13 connected to the lower link 12. The multi-link engine 10 also includes a piston 32 for each cylinder and a crankshaft 33, which are connected by the upper and lower links 11 and 12.

In FIG. 1, the piston 32 of the multi-link engine is illustrated at bottom dead center. FIG. 1 is a cross sectional view taken along an axial direction of the crankshaft 33 of the engine 10. Among those skilled in the engine field, it is customary to use the expressions "top dead center" and "bottom dead center" irrespective of the direction of gravity. In horizontally opposed engines (flat engine) and other similar engines, top dead center and bottom dead center do not necessarily correspond to the top and bottom of the engine, respectively, in terms of the direction of gravity. Furthermore, if the engine is inverted, it is possible for top dead center to correspond to the bottom or downward direction in terms of the direction of gravity and bottom dead center to correspond to the top or upward direction in terms of the direction of gravity. However, in this specification, common practice is observed and the direction corresponding to top dead center is referred to as the "upward direction" or "top" and the direction corresponding to bottom dead center is referred to as the "downward direction" or "bottom."

Now the linkage of the multi-link engine 10, will be described in more detail. An upper end of the upper link 11 is connected to the piston 32 by a piston pin 21, while a lower end of the upper link 11 is connected to one end of the lower link 12 by an upper link pin 22. The piston 32 moves reciprocally inside a cylinder liner 41*a* of a cylinder block 41 in response to combustion pressure. In this embodiment, as shown in FIG. 1, the upper link 11 adopts an orientation substantially parallel to a center axis of the cylinder liner 41*a* and a bottommost portion of the piston 32 is positioned below a bottommost portion of a bottom end of the cylinder liner 41*a* when the piston 32 is at bottom dead center.

Figure 2A:
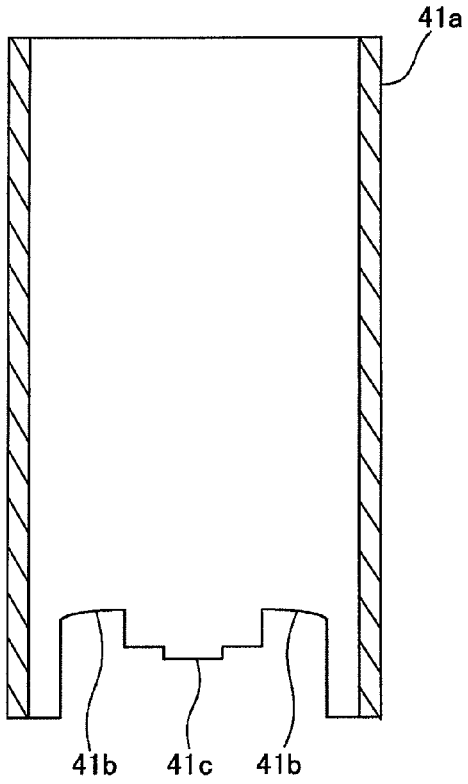
FIG. 2A is a longitudinal cross sectional view of a cylinder liner for the multi-link engine illustrated in FIG. 1 showing a left-hand internal surface of the cylinder liner as viewed from the center axis of the cylinder.
Figure 2B:
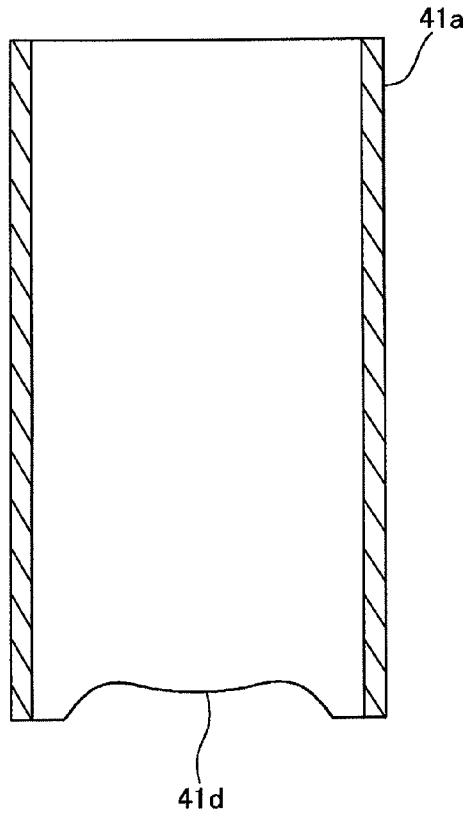
FIG. 2B is a longitudinal cross sectional view of the cylinder liner for the multi-link engine illustrated in FIG. 1 showing a right-hand internal surface of the cylinder liner as viewed from the center axis of the cylinder.

The cylinder liner 41*a* will now be explained with reference to FIGS. 2A and 2B. FIG. 2A is a longitudinal cross sectional view showing a left-hand internal surface of the cylinder liner 41*a* as viewed from the center axis of the cylinder. FIG. 2B is a vertical cross section showing a right-hand internal surface of the cylinder liner 41*a* as viewed from the center axis of the cylinder.

As can be determined from FIG. 1, the crankshaft 33 and the lower link 12 pass through a vicinity of the lower end of the left-hand side of the cylinder liner 41*a*. Therefore, as shown in FIG. 2A, the bottom end of the left-hand side of the inside of cylinder liner 41*a* has a pair of cutouts 41*b* and a cutout 41*c* disposed between the cutouts 41*b*. The cutouts 41*b* are configured and dimensioned to allow a counterweight 33*c* of the crankshaft 33 to pass cutouts 41*b*. The cutout 41*c* is configured and dimensioned to allow the lower link 12 to pass the cutout 41*c*. Consequently, the height of the bottom end of the cylinder liner 41*a* along the axial direction of the cylinder is not fixed but varies from location to location. In this embodiment, the cutouts 41*b* are formed to be deeper than the cutout 41*c*.

As can be determined from FIG. 1, the upper link 11 passes through a vicinity of the lower end of the right-hand side of the cylinder liner 41*a*. Therefore, as shown in FIG. 2B, the bottom end of the right-hand side of the inside of cylinder liner 41*a* has a cutout 41*d*. The cutout 41*d* is configured and dimensioned to allow the upper link 11 to pass through the cutout 41*d*. Consequently, the height of the bottom end of the cylinder liner 41*a* along the axial direction of the cylinder is not fixed but varies from location to location.

Referring again FIG. 1, the crankshaft 33 is provided with a plurality of crank journals 33*a*, a plurality of crank pins 33*b*, and a plurality of counterweights 33*c*. The crank journals 33*a* are rotatably supported by the cylinder block 41 and a ladder frame 42. The crank pin 33*b* for each cylinder is eccentric relative to the crank journals 33*a* by a prescribed amount and the lower link 12 is rotatably connected to the crank pin 33*b*. The lower link 12 has a bearing hole located in its approximate middle. The crank pin 33*b* of the crankshaft 33 is disposed in the bearing hole of the lower link 12 such that the lower link 12 rotates about the crank pin 33*b*. The lower link 12 is constructed such that it can be divided into a left member and a right member (two members). One end of the lower link 12 is connected to the upper link 11 with the upper link pin 22 and the other end of the lower link 12 is connected to the control link 13 with a control link pin 23. The center of the upper link pin 22, the center of the control link pin 23 and the center of the crank pin 33*b* lie on the same straight line when viewed along an axial direction of the crankshaft 33. The reasoning for this positional relationship will be explained later. Preferably, two counterweights 33*c* are provided per cylinder.

The control link pin 23 is inserted through a distal end of the control link pin 13 such that the control link 13 is pivotally connected to the lower link 12. The other end of the control link 13 is arranged such that it can rock about a control shaft 24. The control shaft 24 is disposed substantially parallel to the crankshaft 33, and is supported in a rotatable manner on the engine body. The control shaft 24 comprises a shaft-controlling axle 24*a* and an eccentric pin 24*b*. The control shaft 24 is an eccentric shaft as shown in FIG. 1 with one end of the control link 13 connected to the eccentric pin 24*b* that is offset from a center rotational axis of the shaft-controlling axle 24*a*. In other words, the eccentric pin 24*b* is eccentric relative to the center rotational axis of the shaft-controlling axle 24*a* by a predetermined amount. The control link 13 oscillates or rocks in relation to the eccentric pin 24*b*. The shaft-controlling axle 24*a* of the control shaft 24 is rotatably supported by a control shaft support carrier 43 and a control shaft support cap 44. The control shaft support carrier 43 and the control shaft support cap 44 are fastened together and to the ladder frame 42 with a plurality of bolts 45. In this embodiment, the cylinder block 41, the ladder frame 42 and the control shaft support carrier 43 constitutes an engine block body. By moving the eccentric position of the eccentric pin 24*b*, the rocking center of the control link 13 is moved and the top dead center position of the piston 32 is changed. In this way, the compression ratio of the engine can be mechanically adjusted.

The control shaft 24 is positioned below the center of the crank journal 33*a*. The control shaft 24 is positioned on an opposite side of the crank journal 33*a* from the center axis of the cylinder. In other words, when an imaginary straight line is drawn which passes through the center axis of the crankshaft 33 (i.e., the crankshaft journal 33*a*) and which is parallel to the cylinder axis when viewed along an axial direction of the crankshaft, the control shaft 24 is positioned opposite of the center axis of the cylinder with respect to this imaginary straight line. In FIG. 1, the center axis of the cylinder is positioned rightward of the center axis of the crankshaft journal 33*a* and the control shaft 24 is positioned leftward of the center axis of the crankshaft journal 33*a*. The reason for arranging the control shaft 24 in such a position will be explained later.

Figure 3A:
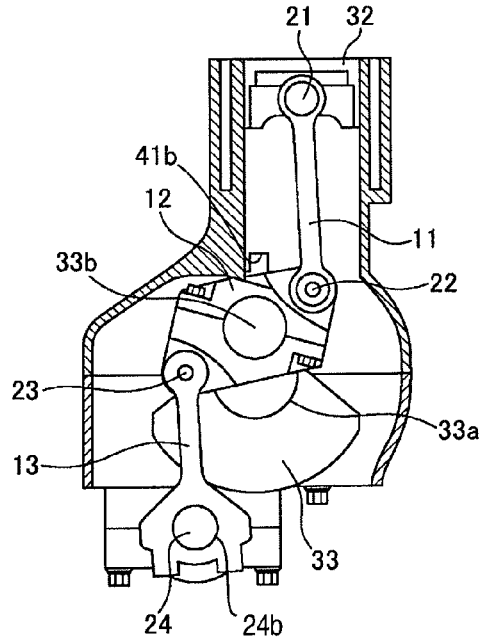
FIG. 3A is a vertical cross sectional view of the multi-link engine illustrated in FIG. 1 where the piston is at top dead center.
Figure 3B:
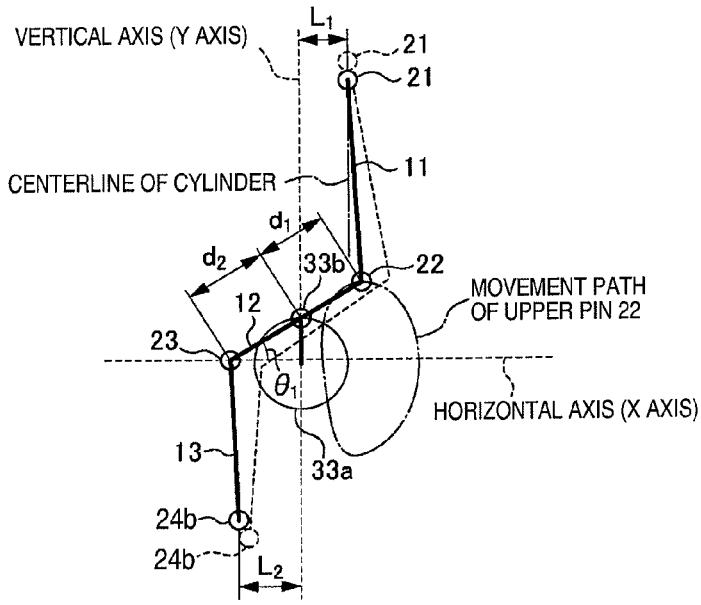
FIG. 3B is a link diagram of the multi-link engine illustrated in FIG. 3A where the piston is at top dead center.
Figure 4A:
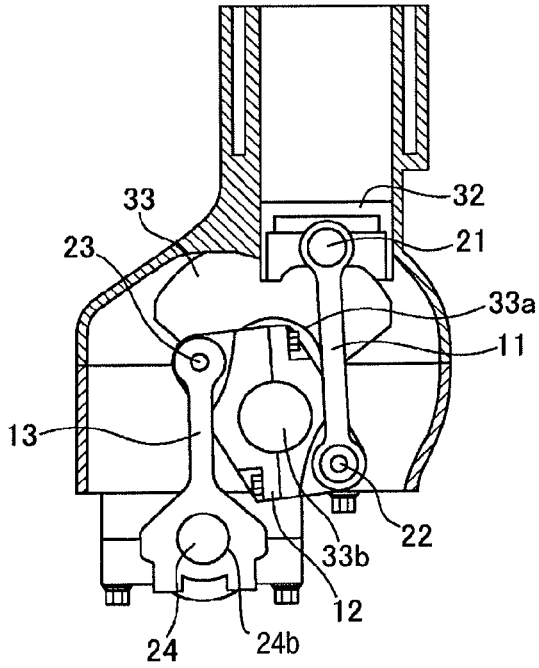
FIG. 4A is a cross sectional view of the multi-link engine illustrated in FIG. 1 where the piston is at bottom dead center.
Figure 4B:
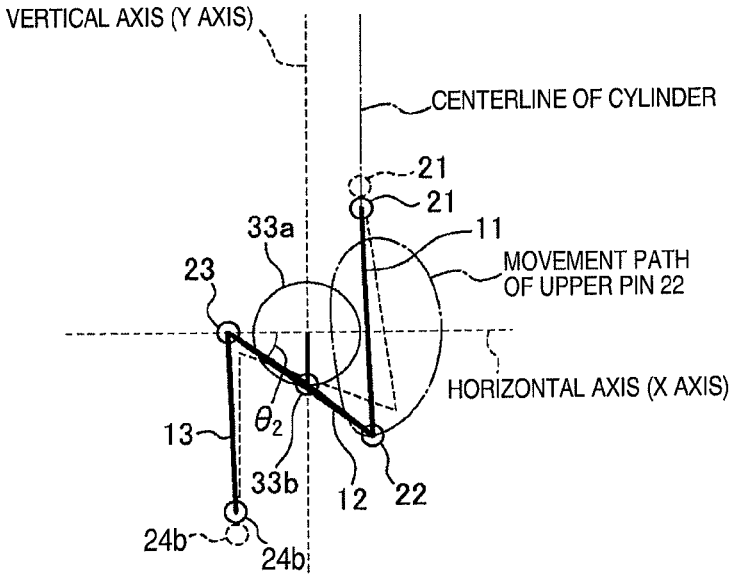
FIG. 4B is a link diagram of the multi-link engine illustrated in FIG. 4A where the piston is at bottom dead center.

FIGS. 3A and 3B show the engine 10 with the piston 32 at top dead center. FIGS. 4A and 4B show the engine with the piston 32 at bottom dead center. In FIGS. 3B and 4B, the solid line illustrates a geometry adopted when the engine is in a low compression ratio state and the broken line illustrates a geometry adopted when the engine is in a high compression ratio state.

As previously mentioned, the center of the upper link pin 22, the center of the control link pin 23, and the center of the crank pin 33*b* lie on the same straight line when viewed from an axial direction of the crankshaft 33. As shown in FIG. 3B, the links 11 and 12 are arranged such that the relationship expressed in the Equation (1) shown below substantially exists among the distance d1 between the center of the crank pin 33*b* and the upper link pin 22, the distance d2 between the center of the crank pin 33*b* and the center of the control link pin 23, the distance L1 from the piston pin 21 to a vertical axis (Y axis) that passes through the axial center of the crank journal 33*a* and is parallel to the center axis of the cylinder, and the distance L2 from the control shaft 24 to the Y axis.

Equation 1

$$\frac{d_2}{d_1} = \frac{L_2}{L_1} \tag{1}$$

A ratio of a distance from a center of the crank pin 33*b* to a center of the control link pin 23 with respect to a distance from the center of the crank pin 33*b* to a center of the upper link pin 22 is substantially equal to a ratio of a distance from a vertical axis (Y axis) that passes through the axial center of the crank journal and is parallel to the center axis of the cylinder with respect to a distance from the vertical axis (Y axis) to the control shaft.

Additionally, the link geometry is further configured such that an angle θ1 (see FIG. 3B) formed between a horizontal axis (X axis) that is perpendicular to the center axis of the cylinder and passes through an axial center of the crank journal 33*a* and a line joining a center of the control link pin 23 and a center of the upper link pin 22 when the piston is at top dead center is the same as the angle θ2 (see FIG. 4B) formed when the piston is at bottom dead center. That is, the link geometry is configured such that θ1 equals θ2.

The links 11 and 12 are also arranged such that position of the control link pin 23 is substantially the same (preferably the same) when the piston 32 is at top dead center as when the piston 32 is at bottom dead center. Furthermore, the links 11 and 12 are arranged such that the center of the control link pin 23 is positioned on the horizontal axis (X axis) when the piston 32 is at top dead center or bottom dead center.

The link geometry is also configured such that the bottom-most point of the movement path of the upper link pin 22 is substantially directly (preferably directly) below the center axis of the cylinder.

The position of the control shaft 24 is arranged such that the center axis of the control link 13 is substantially vertical (preferably vertical) when the piston 32 is positioned at top dead center (FIGS. 3A and 3B) and such that the center axis of the control link 13 is substantially vertical (preferably vertical) when the position 32 is positioned at bottom dead center (FIGS. 4A and 4B). When viewed along an axial direction of the crankshaft 33, the center axis of the control link 13 lies on a straight line joining the center of the eccentric pin 24*b* of the control shaft 24 and the center of the control link pin 23.

The reasons for arranging the links 11 and 12 as described above will now be explained.

First, the reason for arranging the links 11 and 12 such that the relationship expressed in the Equation (1) will be explained.

When a load F1 acts on the piston pin 21 along the axial direction of the cylinder and a load F2 acts on the control shaft 24 along the axial direction of the cylinder, the relationship expressed in the Equation (2) below exists.

Equation (2)

$$F_2 = F_1 \times \frac{d_1}{d_2} \tag{2}$$

Thus, the relationship expressed in the Equation (3) below also exists.

Equation (3)

$$\begin{aligned} F_2 \times L_2 &= F_1 \times \frac{d_1}{d_2} \times L_2 \\ &= F_1 \times \frac{d_1}{d_2} \times \frac{d_2}{d_1} \times L_1 \left( \because \text{Equation (1)} \ \frac{L_2}{L_1} = \frac{d_2}{d_1} \right) \\ &\because F_2 \times L_2 = F_1 \times L_1 \end{aligned} \tag{3}$$

Thus, by arranging the links 11 and 12 such that Equation (1) is satisfied, a moment acting about the crankshaft 33 can be set to zero. When a large load is produced due to the combustion of gas in the engine, the pressure of the combustion gas generates a force acting on the cylinder head in a direction of raising the cylinder head upward, a force acting on the control shaft 24 through the link mechanism in a direction of raising the cylinder block 41 upward, and a force acting on the crankshaft 33 in a direction of pushing the cylinder block 41 downward. A moment generated about the crankshaft in the cylinder block 41 by the upward force (load F1) acting against the cylinder head and a moment generated about the crankshaft by the upward force (load F2) acting on the control shaft 24 have approximately the same magnitude as shown in the Equation (3) and are oriented in opposite directions, thus cancelling each other out. As a result, torsional vibration can be prevented from occurring in the cylinder block due to a pressure load inside the cylinder causing a moment oriented about the crankshaft to act on the cylinder block.

The reason for positioning the control link pin 23 such that angle θ1 equals angle θ2 will now be explained.

Figure 5A:
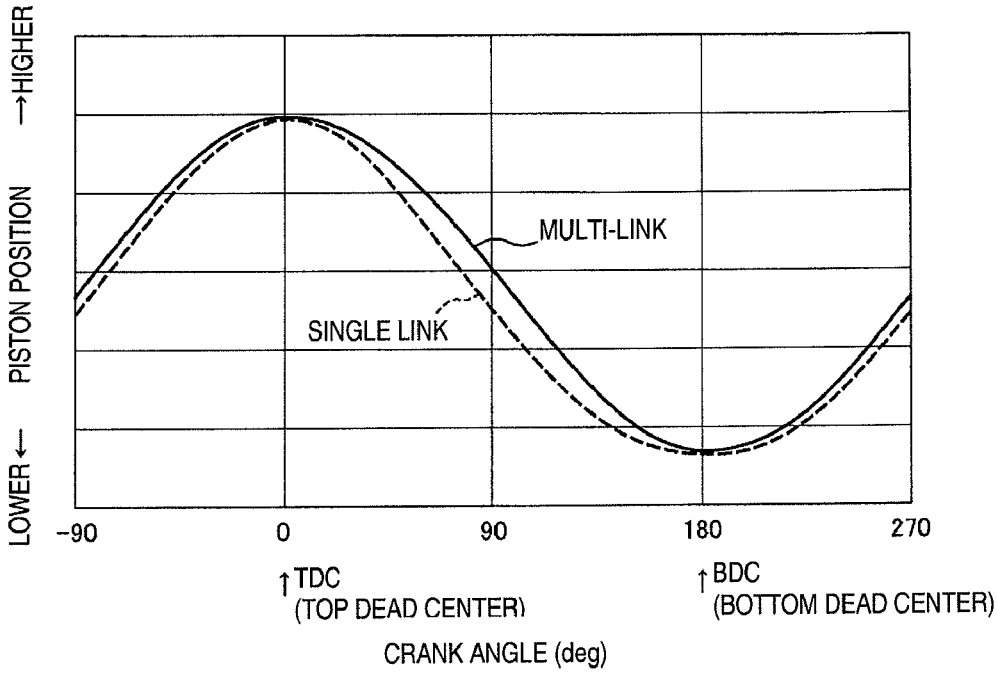
FIG. 5A is a graph that plots of the piston displacement versus the crank angle.
Figure 5B:
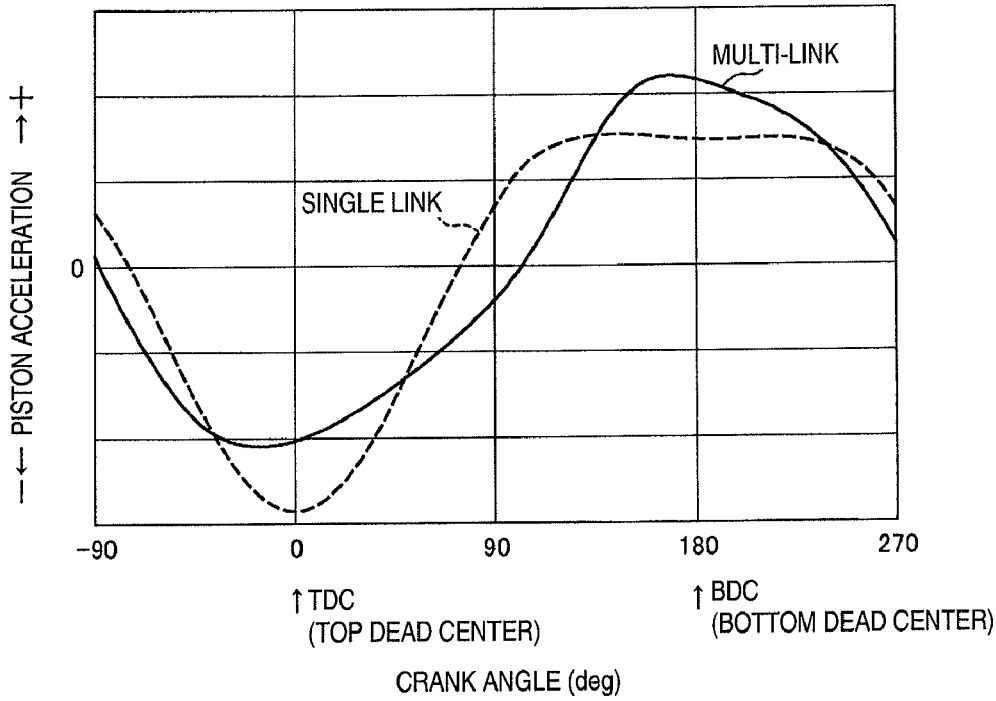
FIG. 5B is a graph that plots of the piston acceleration versus the crank angle.

FIGS. 5A and 5B show plots of the piston displacement and piston acceleration versus the crank angle.

In a multi-link engine, even when the connecting rod ratio λ (=upper link length l/crank radius r) is not a large value but is a common value (e.g., 2.5 to 4), the amount of piston movement with respect to a prescribed change in crank angle is smaller than in a single-link engine when the piston is near top dead center and larger than in a single-link engine when the piston is near bottom dead center, as shown in FIG. 5A. The movement acceleration of the piston is as shown in FIG. 5B. Thus, the acceleration of the piston is smaller in a multi-link engine than in a single-link engine when the piston is near top dead center and larger in a multi-link engine than in a single-link engine when the piston is near bottom dead center, and the vibration characteristic of the multi-link engine is close to having a single component.

In a multi-link engine, not only is the acceleration of the piston larger in the vicinity of bottom dead center than in a single-link engine, but the number of component parts is larger than in a single-link engine. Consequently, the inertial mass is larger and the inertia force generated when the piston is near bottom dead center is larger.

When the piston 32 reverse direction at bottom dead center and starts rising, the reaction force resulting from the inertia force is born by the upper link 11. The direction of this reaction force matches the direction of the axial centerline of the upper link 11 and can be resolved into a component oriented in the direction of the center axis of the cylinder and a component oriented in the radial direction of the cylinder (thrust force direction). The component oriented in the radial direction of the cylinder causes the piston 32 to be pressed against the cylinder liner 41*a*.

In this way, when the piston 32 is near bottom dead center, a bottommost portion thereof is positioned lower than the cylinder liner 41*a* and the sliding surface area is small. A multi-link engine also features the ability to lengthen the piston stroke, and the sliding surface area between the piston 32 and the cylinder liner 41*a* is even smaller because a removed portion is formed in bottom of the cylinder liner 41*a*.

Thus, when the piston 32 is pushed against the cylinder liner 41*a*, the surface pressure increases in the vicinity of the removed portion (e.g., cutouts 41*b* and 41*c*) where the rigidity of the cylinder liner 41*a* is weaker. Thus, there is the possibility that the cylinder liner 41*a* will undergo deformation and the contact state between the cylinder liner 41*a* and the piston skirt will degrade. Also, when the piston 32 experiences a large thrust load, there is the possibility that an edge of the removed portion of the cylinder liner 41*a* will cause a film of lubricating oil on the piston skirt to be scraped off.

However, in this embodiment, the link geometry is configured such that the angle θ1 (see FIG. 3B) formed between a horizontal axis (X axis) that is perpendicular to an center axis of the cylinder and passes through an axial center of the crank journal 33*a* and an imaginary straight line joining a center of the control link pin 23 and a center of the upper link pin 22 when the piston 32 is at top dead center is the same as the angle θ2 (see FIG. 4B) formed when the piston 32 is at bottom dead center. That is, the link geometry is configured such that angle θ1 equals angle θ2. Thus, the position of the upper link pin 22 along the direction of the horizontal axis (X axis) is the same when the piston 32 is at top dead center as when the piston 32 is at bottom dead center. Also the movement path of the upper link pin 22 is not elongated to the left and right but, instead, has the shape of an ellipse whose longer dimension is oriented vertically, as shown in FIGS. 3B and 4B. As a result, when the piston 32 changes direction at bottom dead center and starts rising, the component of an inertial reaction force that acts on the piston 32 in a radial direction of the cylinder (thrust force direction) is smaller. Consequently, a side thrust force that acts to push the piston 32 against the cylinder liner 41*a* is smaller and deformation of the cylinder liner and deficiency of the lubricating oil film of the piston skirt can be prevented.

Conversely, if the link geometry is configured such that an angle θ1 (see FIG. 3B) formed between a horizontal axis (X axis) that is perpendicular to an center axis of the cylinder and passes through an axial center of the crank journal 33*a* and an imaginary straight line joining a center of the control link pin 23 and a center of the upper link pin 22 when the piston is at top dead center is not the same as the angle θ2 (see FIG. 4B) formed when the piston 32 is at bottom dead center and the elliptical shape of the movement path of the upper link pin 22 is oriented such that the longer dimension thereof is tilted horizontally, then degree to which the upper link leans toward a horizontal direction will be larger and the side thrust force will increase.

Figure 11:
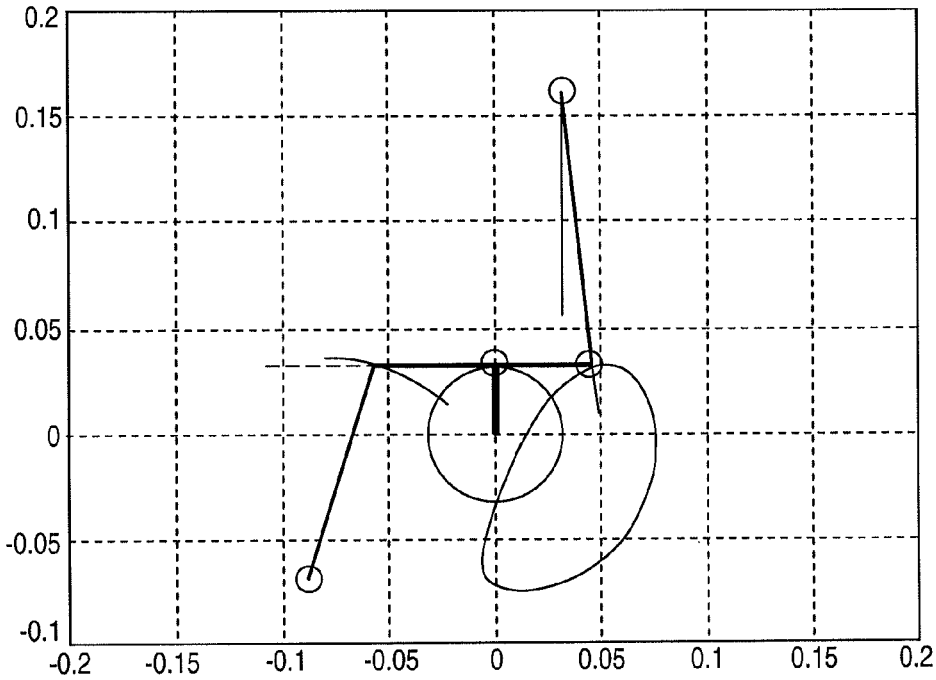
FIG. 11 is a link diagram illustrating a comparative example that corresponds to FIG. 3B.
Figure 12:
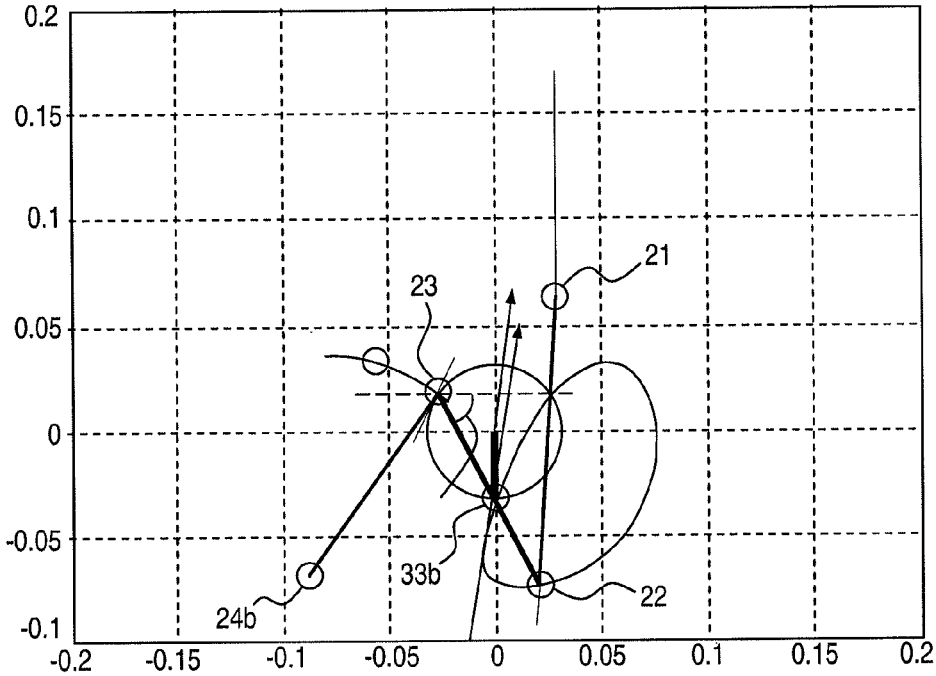
FIG. 12 is a link diagram illustrating the comparative example that corresponds to FIG. 4B.

FIGS. 11 and 12 are provided as a comparative example corresponding to FIGS. 3B and 4B of this embodiment. In the comparative example, the elliptical path is tilted such that the top portion of the ellipse, i.e., the portion corresponding to top dead center, is more distant from the center of the crankshaft 33 and the bottom portion, i.e., the portion corresponding to bottom dead center, is closer to the center of the crankshaft 33.

Consequently, the angle θ1 formed when the piston 32 is at top dead center is smaller than the angle θ2 formed when the piston 32 is at bottom dead center. As a result, the width of the ellipse increases in the direction perpendicular to the center axis of the cylinder and the degree to which the upper link 11 leans toward the horizontal direction increases, thus causing the side thrust force to increase. Also, since the ellipse is leaning, the piston stroke decreases. In other words, in order to obtain the same piston stroke, the movement path of the upper link pin 22 needs to be increased, which in turn causes the size of the engine to increase. Meanwhile, in this embodiment, by making θ1 equal θ2, the elliptical movement path of the upper link pin 22 is elongated in the vertical direction and the movement of the upper link pin 22 can be correlated efficiently to the size of the engine stroke. In other words, the engine can be made more compact.

Additionally, if the links 11 and 12 are arranged such that the position of the control link pin 23 is the same when the piston 32 is at top dead center as when the piston 32 is at bottom dead center and such that the center of the control link pin 23 is positioned on the horizontal axis (X axis) both when the piston 32 is at top dead center and when the piston 32 is at bottom dead center, then the vertically elongated elliptical path of the upper link pin 22 will be even more vertically oriented and the effects of the invention will be exhibited more demonstrably.

By further configuring the link geometry such that the bottommost point of the movement path of the upper link pin 22 is substantially directly below the center axis of the cylinder, the axial centerline of the upper link 11 is oriented in substantially the same direction as the center axis of the cylinder when the piston 32 is at bottom dead center. As a result, when the piston 32 changes direction at bottom dead center and starts rising, the inertial reaction force that acts on the piston 32 comprises substantially only a component in the direction of the center axis of the cylinder and the component oriented in the radial direction of the cylinder (thrust force direction) is almost nonexistent. Thus, there is substantially no occurrence of a thrust force pushing the piston 32 against the cylinder liner 41*a*. As a result, deformation of the cylinder liner 41*a* and deficiency of the lubricating oil film on the piston skirt can be prevented in an effective manner.

As explained previously, by making the control shaft 24 as an eccentric shaft and moving the position of the eccentric pin 24*b* of the control shaft 24 with respect to the pivot axis of the control shaft 24, the rocking center of the control link 13, and thus, the top dead center position of the piston 32 can be changed. In this way, the compression ratio can be mechanically adjusted. When the engine is configured such that the compression ratio can be adjusted, the compression ratio should be lowered when the engine is operating with a high load. When the load is high, both sufficient output and prevention of knocking can be achieved by lowering the mechanical compression ratio and setting the intake valve close timing to occur near bottom dead center. Meanwhile, the compression ratio should be lowered when the engine is operating with a low load. When the load is low, the expansion ratio can be increased on the exhaust loss can be reduced by adjusting the intake valve close timing away from bottom dead center and adjusting the exhaust valve open timing to occur near bottom dead center. During high load operation, the piston 32 is more likely to experience a large thrust force that pushes the piston 32 against the cylinder liner 41*a*. Therefore, the link geometry should be configured such that difference between the angles θ1 and θ2 is smaller, i.e., such that the values of the angle θ1 (see FIG. 3B) and the angle θ2 (see FIG. 4B) are closer, when the compression ratio is low than when the compression ratio is high. (The angles θ1 and θ2 illustrated with solid lines in the figures correspond to a low compression ratio and are substantially the same angle, i.e., the difference between them is substantially zero. The angles θ1 and θ2 illustrated with broken lines correspond to a higher compression ratio and the difference there-between is larger than in the low compression ratio case.) By controlling the link geometry in this way, the effect of reducing the thrust force that acts to push the piston 32 against the cylinder liner 41*a* can be exhibited more demonstrably, particularly when a low compression ratio is used during high load operation.

As explained previously, in this embodiment, the position of the control shaft 24 is arranged such that the center axis of the control link 13 is substantially vertical (preferably vertical) when the piston 32 is positioned at top dead center (FIGS. 3A and 3B) and such that the center axis of the control link 13 is substantially vertical (preferably vertical) when the position 32 is positioned at bottom dead center (FIGS. 4A and 4B). Also, as seen in FIGS. 3B and 4B, the control shaft 24 is positioned lower than the crank journal 33*a* (i.e., below the X axis), with the control shaft 24 also being disposed on a first side of a plane that is parallel to a cylinder center axis of the cylinder liner 41*a* and that contains a center rotational axis of the crank journal 33*a*. This plane is shown in FIGS. 3B and 4B as containing the Y axis. The cylinder center axis of the cylinder liner 41*a* is located on a second side of the plane (i.e., the plane containing the Y axis). The reason for positioning the control shaft 24 in such a fashion will now be explained. In order to make the explanation easier to understand, the engine block will first be explained with reference to the vertical cross sectional view of the engine block shown in FIG. 6.

The ladder frame 42 is bolted to the cylinder block 41. A hole 40*a* is formed in the ladder frame 42 and the cylinder block 41 for rotatably supporting the crank journal 33*a* of the crankshaft 33. The plane of contact between the ladder frame 42 and the cylinder block 41 intersects perpendicularly with the center axis of the cylinder. The center axes of the bolts fastening the ladder frame 42 and the cylinder block 41 together are perpendicular to this plane of contact. In other words, the center axes of the bolts are parallel to the center axis of the cylinder.

Figure 6:
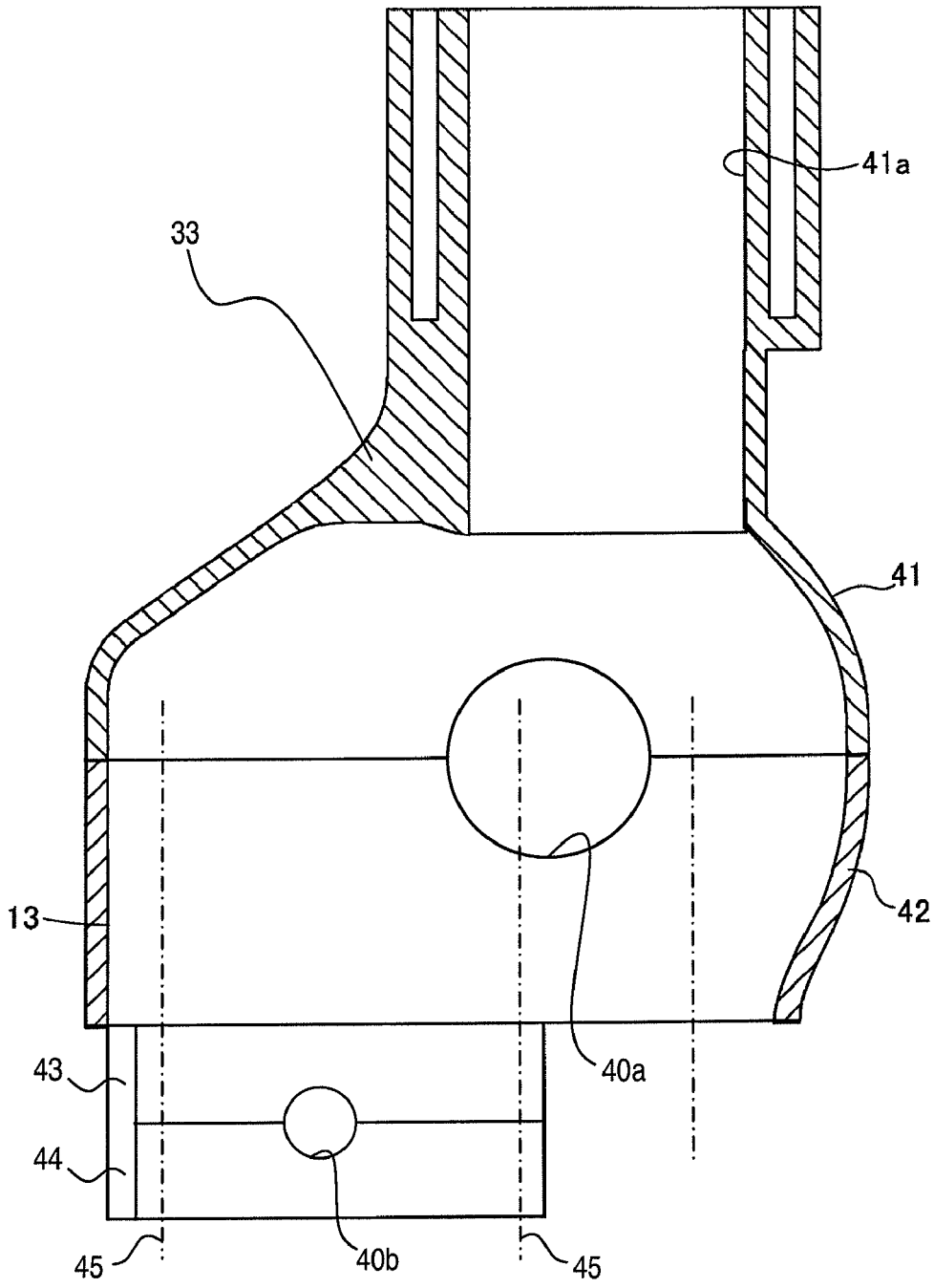
FIG. 6 is a vertical cross sectional view of the engine block of the multi-link engine illustrated in FIG. 1.

The control shaft support carrier 43 and the control shaft support cap 44 are fastened together and to the ladder frame 42 with the bolts 45. The center axis of the bolts 45 are indicated in FIG. 6 with single-dot chain lines. A hole 40*b* is formed by the control shaft support carrier 43 and the control shaft support cap 44 and the shaft-controlling axle 24*a* of the control shaft 24 is rotatably supported in the hole 40*b*. The plane of contact between the control shaft support carrier 43 and the ladder frame 42 intersects perpendicularly with the center axis of the cylinder. The plane of contact between the control shaft support cap 44 and the control shaft support carrier 43 also intersects perpendicularly with the center axis of the cylinder. The center axes of the bolts 45 intersect perpendicularly with these planes of contact. In other words, the center axes of the bolts 45 are parallel to the center axis of the cylinder.

When the control shaft 24 is supported in this fashion, the loads acting on the piston 32 due to combustion pressure and inertia are transmitted to the control shaft 24 through the links 11 and 12. If the load acts to push the control shaft 24 downward, then the control shaft support cap 44 could become misaligned relative to the control shaft support carrier 43, resulting in a so-called "open mouth" state. The load acting on the piston 32 due to combustion pressure and inertia is at a maximum when the piston is near top dead center or bottom dead center. At such times, if the control link 13 is oriented vertically (i.e., parallel to the center axis of the cylinder), then the control shaft 24 will be pushed in the axial direction of the control link 13 (i.e., straight downward) and the downward pushing force will be applied to the bolts 45. Meanwhile, if the control link 13 is tilted, the control shaft 24 will be pushed downward in the axial direction of the control link 13. Since the control link 13 is tilted, a component of the downward pushing force oriented in the axial direction of the bolts 45 will be applied to the bolts 45 and a component of the downward pushing force oriented in a direction perpendicular to the axial direction of the bolts 45 will act to cause the control shaft support cap 44 to shift position relative to the control shaft support carrier 43. Therefore, as explained previously, the position of the control shaft 24 is arranged such that the center axis of the control link 13 is substantially vertical (preferably vertical) when the piston 32 is positioned at top dead center (FIGS. 3A and 3B) and such that the center axis of the control link 13 is substantially vertical (preferably vertical) when the position 32 is positioned at bottom dead center (FIGS. 4A and 4B).

Figure 7A:
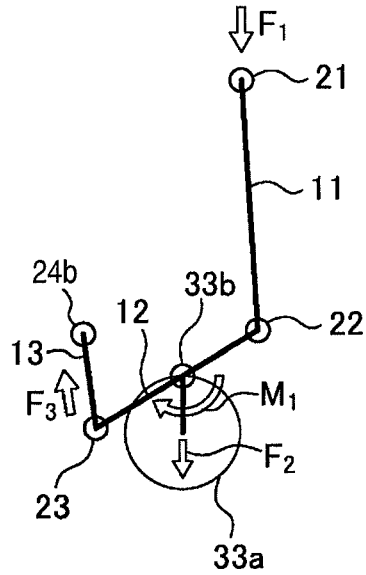
FIG. 7A is a link diagram for explaining the position in which the shaft-controlling axle of the control shaft is arranged.
Figure 7B:
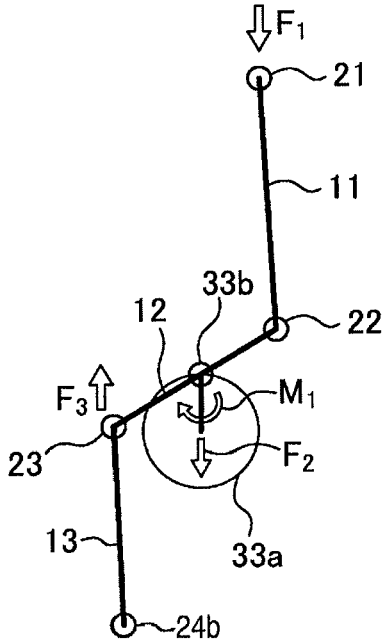
FIG. 7B is a link diagram for explaining the position in which the shaft-controlling axle of the control shaft is arranged.

FIGS. 7A and 7B show diagrams for explaining the position in which the control shaft 24 is arranged. FIG. 7A is a comparative example in which the control shaft 24 is arranged in a position higher than the crank journal 33*a*. FIG. 7B is illustrates the present embodiment, in which the control shaft 24 is arranged lower than the crank journal 33*a*. In this embodiment, as explained previously, the control shaft 24 is positioned lower than the crank journal 33*a* and on the opposite side of the crank journal 33*a* as the center axis of the cylinder. The reason for positioning the control shaft 24 in such a fashion will now be explained.

First, the comparative example shown in FIG. 7A will be explained to help the reader more readily understand the reasoning behind the position of the control shaft 24 in the embodiment.

It is possible to arrange the control shaft 24 in a position higher than the crank journal 33*a* as shown in FIG. 7A. However, the strength of the control link 13 becomes an issue when such a structure is adopted.

More specifically, the largest of the loads that will act on the control link 13 will be the load caused by combustion pressure. The load F1 resulting from the combustion pressure acts downward against the upper link 11. As a result of the downward load F1, a downward load F2 acts on a bearing portion of the crank journal 33*a* and a clockwise moment M1 acts about the crank pin 33*b*. Meanwhile, an upward load F3 acts on the control link 13 as a result of this moment M1. Thus, a compressive load acts on the control link 13. When a large compressive load acts on the control link 13, there is the possibility that the control link 13 will buckle. According to the Euler buckling equation shown as Equation (4) below, the buckling load is proportional to the square of the link length l.

Equation (4)
Euler Buckling Equation $$P_{cr} = n\pi^2 \frac{EI}{l^2} \tag{4}$$

Where
Pcr: buckling load
n: end condition coefficient
E: longitudinal modulus of elasticity
I: second moment of inertia
l: link length Thus, the link cannot be made too long if bucking is to be avoided. In order to increase the link length l, it is necessary to increase the link width and link thickness so as to increase the second moment of inertia. This approach is not practical because of the resulting weight increase and other problems. Consequently, the length of the control link 13 must be short and the distance over which an end thereof (i.e., the control link pin 23) moves cannot be made to be long. Thus, the size of the engine cannot be increased and the desired engine output is difficult to achieve.

Conversely, in the present embodiment shown in FIG. 7B, the control shaft 24 is arranged lower than the crank journal 33*a*. In this way, the load F1 resulting from combustion pressure is transmitted from the upper link 11 to the lower link 12 and a tensile load acts on the control link 13. When a tensile load acts on the control link 13, the possibility of elastic failure of the control link 13 must be taken into consideration. Whether or not elastic failure will occur is generally believed to depend on the stress or strain of the link cross section and to be affected little by link length. Moreover, the maximum principle strain theory indicates that increasing the link length will decrease the strain resulting from a given tensile load and, thus, make the link less likely to undergo elastic failure.

Thus, since it is preferable to configure the link geometry such that the load resulting from combustion pressure is applied to the control link 13 as a tensile load, this embodiment arranges the control shaft 24 lower than the crank journal 33*a*.

Also, as explained previously, in this embodiment the center of the upper link pin 22, the center of the control link pin 23, and the center of the crank pin 33*b* are arranged on a single imaginary straight line. The reason for this arrangement will now be explained.

Figure 8A:
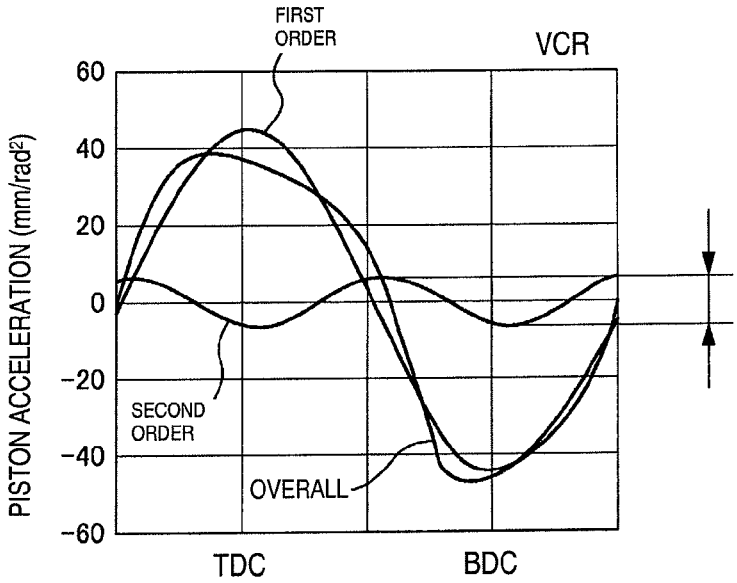
FIG. 8A is a graph that plots the piston acceleration versus the crank angle for explaining a piston acceleration characteristic of a variable compression ratio (VCR) multi-link engine.
Figure 8B:
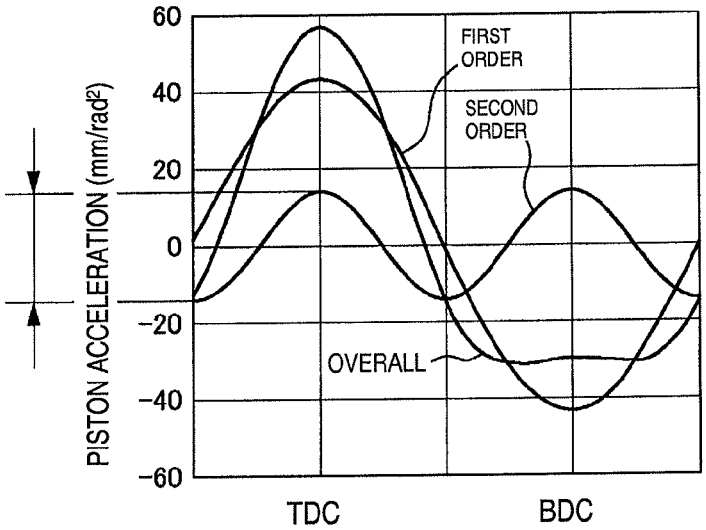
FIG. 8B is a graph that plots the piston acceleration versus the crank angle for explaining a piston acceleration characteristic of a conventional single-link engine.

According to analysis, a multi-link engine can be made to have a lower degree of vibration than a single-link engine by adjusting the position of the control shaft appropriately. The results of the analysis are shown in FIGS. 8A and 8B which shows diagrams comparing the piston acceleration characteristics for a multi-link engine to a single-link engine. FIG. 8A is a plot of piston acceleration characteristic curves versus the crank angle for a multi-link engine. FIG. 8B is a plot of piston acceleration characteristic curves versus the crank angle for a single-link engine as a comparative example. This is a comparison with a common single-link engine in which the ratio of the connecting rod length to the stroke is about 1.5 to 3. Assuming the upper link of the multi-link engine is equivalent to the connecting rod of the single-link engine, the comparison is made under the conditions that the stroke lengths are the same and that the upper link of the multi-link engine has the same length as the connecting rod of the single-link engine.

As shown in FIG. 8B, with the single-link engine, the magnitude (absolute value) of the overall piston acceleration obtained by combining a first order component and a second order component is small in a vicinity of bottom dead center than in a vicinity of top dead center. Conversely, as shown in FIG. 8A, with the multi-link engine the magnitude (absolute value) of the overall piston acceleration is substantially the same at both bottom dead center and top dead center. Additionally, the magnitude of the second order component is smaller in the case of the multi-link engine than in the case of the single-link engine, illustrating that the multi-link engine enables second order vibration to be reduced.

Figure 9A:
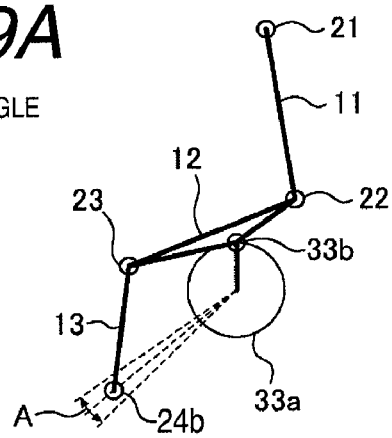
FIG. 9A is a link diagram for explaining positions in which the control shaft can be arranged in order to reduce a second order vibration.
Figure 9B:
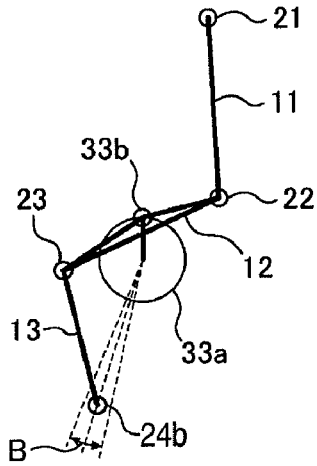
FIG. 9B is a link diagram for explaining positions in which the control shaft can be arranged in order to reduce a second order vibration.
Figure 9C:
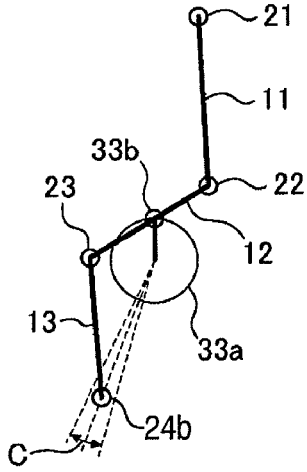
FIG. 9C is a link diagram for explaining positions in which the control shaft can be arranged in order to reduce a second order vibration.

As explained previously, the vibration characteristic of a multi-link engine can be improved (in particular, the second order vibration can be reduced) by positioning the control shaft appropriately. FIGS. 9A to 9C are diagrams for explaining positions where the control shaft can be arranged when the piston 32 is at top dead center in order to reduce the second order vibration. FIG. 9A shows a case in which the crank pin is positioned lower than a line joining the upper link pin 22 and the control link pin 23, FIG. 9B shows a case in which the crank pin 33*b* is positioned higher than a line joining the upper link pin 22 and the control link pin 23, and FIG. 9C shows a case in which the crank pin 33*b* is positioned on a line joining the upper link pin 22 and the control link pin 23.

When the crank pin 33*b* is positioned lower than a line joining the upper link pin 22 and the control link pin 23 as shown in FIG. 9A, the second order vibration can be reduced by positioning the control shaft 24 in the region indicated with the arrows A in the FIG. 9A. In order to use the control link 13 whose length has been set based on the required performance of the engine, the control shaft 24 is positioned leftward of the control link pin 23 (i.e., farther from the crank journal 33*a*).

When the crank pin 33*b* is positioned higher than a line joining the upper link pin 22 and the control link pin 23 as shown in FIG. 9B, the second order vibration can be reduced by positioning the control shaft 24 in the region indicated with the arrows B in the FIG. 9B. In order to use a control link 13 whose length has been set based on the required performance of the engine, the control shaft 24 is positioned rightward of the control link pin 23 (i.e., closer to the crank journal 33*a*).

When the crank pin 33*b* is positioned on a line joining the upper link pin 22 and the control link pin 23 as shown in FIG. 9C, the second order vibration can be reduced by positioning the control shaft 24 in the region indicated with the arrows C in the figure. In order to use a control link 13 whose length has been set based on the required performance of the engine, the control shaft 24 is positioned directly under the control link pin 23. In this embodiment, as explained previously, the control shaft 24 is positioned such that the center axis of the control link 13 is oriented substantially vertically (standing substantially straight up), and preferably vertically, when the piston 32 is positioned at top dead center and when the piston 32 is positioned at bottom dead center. In order to achieve such a geometry while also reducing the second order vibration, it is necessary to arrange the crank pin 33*b* on the line joining the upper link pin 22 and the control link pin 23.

Figure 10A:
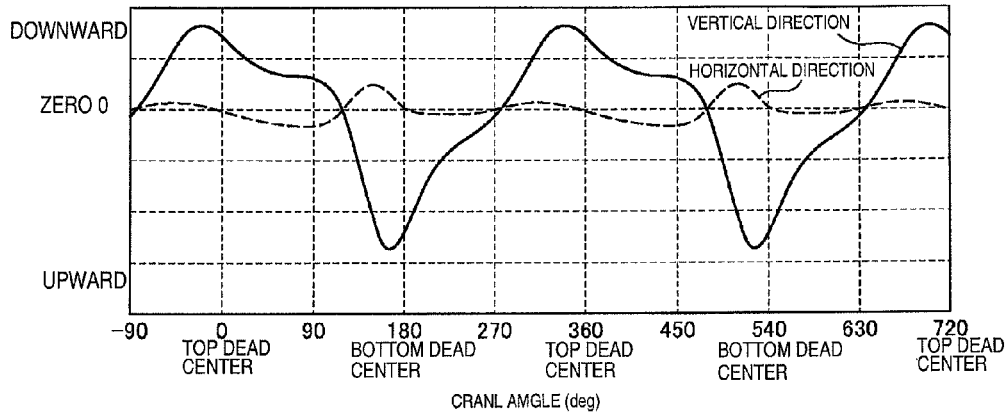
FIG. 10A is a graph that shows the fluctuation of load acting on a distal end of a control link (control shaft) from inertia in a multi-link engine having a link geometry in accordance with the illustrated embodiment.
Figure 10B:
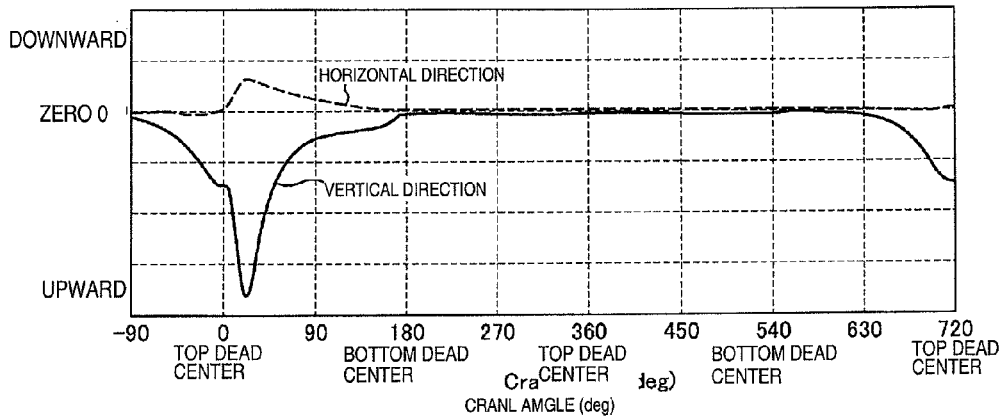
FIG. 10B is a graph that shows the fluctuation of load acting on a distal end of a control link (control shaft) from combustion pressure in a multi-link engine having a link geometry in accordance with the illustrated embodiment.
Figure 10C:
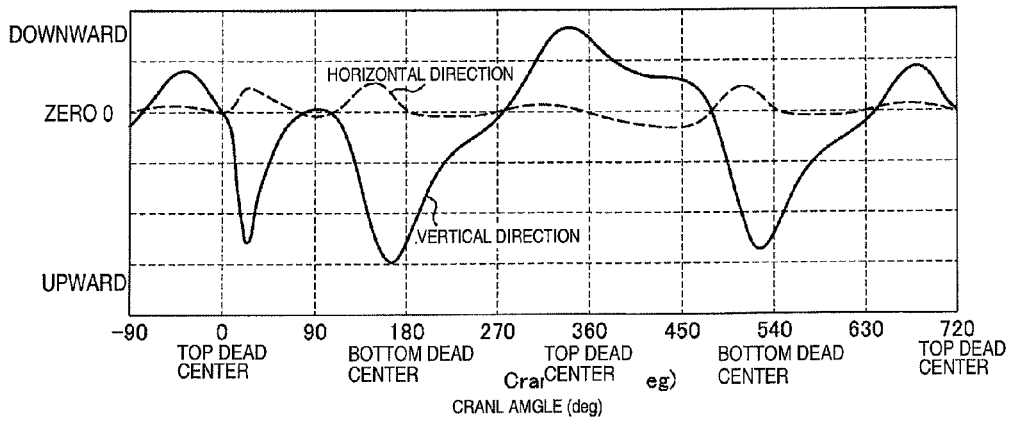
FIG. 10C is a graph that shows the fluctuation of a resultant load that combines the loads shown in FIGS. 10A and 10B) acting on a distal end of a control link (control shaft) in a multi-link engine having a link geometry in accordance with the illustrated embodiment.

When such a link geometry is adopted, a force that fluctuates according to a 360-degree cycle acts on the distal end of the control link 13 due to an inertia force resulting from the acceleration characteristic of the piston 32 and is transmitted to the control shaft 24 of the multi-link engine 10 as shown in FIG. 10A. Additionally, a force that results from combustion pressure and fluctuates according to a 720-degree cycle acts on the distal end of the control link 13 and is transmitted to the control shaft 24 as shown in FIG. 10B. Thus, a resultant force (combination of the two forces) that fluctuates according to a 720-degree cycle acts on the distal end of the control link 13 and is transmitted to the control shaft 24 as shown in FIG. 10C.

These downward loads act to separate the control shaft support cap 44 from the control shaft support carrier 43 and there is the possibility that the control shaft support cap 44 will shift out of position relative to the control shaft support carrier 43 if a horizontally oriented load happens to act at the same time. In order counteract this possibility, it is necessary to increase the number of bolts 45 or to increase the size of the bolts 45 so as to achieve a sufficient axial force fastening the control shaft support carrier 43 and control shaft support carrier 44 together.

However, it has been observed that the size (magnitude) of the load acting on the control link 13 as a result of inertia forces and combustion pressure reaches a maximum when the piston is at top dead center and when the piston is at bottom dead center. In this embodiment, the link geometry of the multi-link engine is configured such that the control link 13 is oriented substantially vertically (preferably vertically) when the piston is at top dead center and when the piston is at bottom dead center. In this way, a horizontally oriented load can be prevented from acting on the distal end of the control link 13 and transmitted to the control shaft 24 when the magnitude of the load acting on the control link 13 is at a maximum and the control shaft support cap 44 can be prevented from shifting out of position relative to the rocking center support carrier 43.

Although in the illustrated embodiment the control shaft 24 is supported with a control shaft support carrier 43 and a control shaft support cap 44 that are bolted together and to the ladder frame 42 with bolts 45, it is acceptable for the control shaft support carrier 43 to be formed as an integral part of the ladder frame 42. In such a case, the cylinder block 41 and the ladder frame 42 correspond to the engine block body.

In the illustrated embodiment, as mentioned above, the crank pin 33*b* of the crankshaft 33 is arranged on a line joining the upper link pin 22 and the control link pin 23, and an angle formed between a horizontal axis (X axis) that is perpendicular to an center axis of the cylinder and passes through an axial centerline of the crank journal of the crankshaft 33 and a line joining a center of the control link pin 23 and a center of the upper link pin 22 is substantially the same when the piston 32 is at top dead center as when the piston 32 is at bottom dead center. As a result, the movement path of the upper link pin 22 has the shape of an ellipse that is longer in a vertical direction and a component of an inertial reaction force that acts on the piston 32 in a radial direction of the cylinder (thrust force direction) when the piston 32 changes direction at bottom dead center and starts rising is reduced. Consequently, a thrust force that acts to push the piston against the cylinder liner 41*a* is smaller and deformation of the cylinder liner 41*a* and deficiency of the lubricating oil film of the piston skirt can be prevented. Additionally, since the movement path of the upper link pin 22 has the shape of an ellipse that is longer in a vertical direction, the movement of the upper link pin 22 can be efficiently correlated to the size of the engine stroke, i.e., the engine can be made more compact.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A multi-link engine comprising:

an engine block body including at least one cylinder;

a crankshaft including a crank pin;

a piston operatively coupled to the crankshaft to reciprocally move inside the cylinder of the engine;

an upper link rotatably connected to the piston by a piston pin;

a lower link rotatably connected to the crank pin of the crankshaft and rotatably connected to the upper link by an upper link pin; and a control link rotatably connected at one end to the lower link by a control link pin and rotatably connected at another end to the engine block body by a control shaft, the crank pin of the crankshaft having a center arranged on an imaginary straight line joining centers of the upper link pin and the control link pin, an angle formed between the imaginary straight line and a horizontal axis that is perpendicular to a center axis of the cylinder and that passes through an axial center of a crank journal of the crankshaft being the same when the piston is at top dead center as when the piston is at bottom dead center.

2. The multi-link engine as recited in claim 1, wherein the control link pin has a position that remains the same when the piston is at top dead center as when the piston is at bottom dead center, with the position of the control link pin being located on the horizontal axis.

3. The multi-link engine as recited in claim 1, wherein the upper link pin moves along a movement path having a bottommost point that is directly below the center axis of the cylinder.

4. The multi-link engine as recited in claim 1, wherein the control shaft being positioned lower than the crank journal of the crankshaft and disposed on a first side of a plane that is parallel to the center axis of the cylinder and that contains a center rotational axis of the crank journal, while the center axis of the cylinder is located on a second side of the plane with the first side of the plane being opposite from the second side of the plane, the control shaft is rotatably supported between the engine block body and a control shaft support cap fastened to the engine block body, and the control link has a center axis that is parallel to the center axis of the cylinder when the piston is near top dead center and when the piston is near bottom dead center.

5. The multi-link engine as recited in claim 4, wherein the control shaft support cap and the engine block body have mating contact surfaces that intersect perpendicularly with the center axis of the cylinder; and the control shaft support cap being fastened to the engine block body by at least one bolt that has a center axis parallel to the center axis of the cylinder.

6. The multi-link engine as recited in claim 1, wherein the centers of the crank pin and the control link pin are spaced apart by a first distance and the centers of the crank pin and the upper link pin are spaced apart by a second distance, with a ratio of the first distance to the second distance being equal to a ratio of a distance from a vertical axis that passes through the axial center of the crank journal and that is parallel to the center axis of the cylinder to a distance from the vertical axis to a rotation axis of the control link about the control shaft.

7. The multi-link engine as recited in claim 1, wherein the upper link, the lower link and the control link are arranged with respect to each other such that a size of a relative maximum value of a reciprocal motion acceleration of the piston when the piston is near bottom dead center is equal to or larger than a size of a relative maximum value of a reciprocal motion acceleration of the piston when the piston is near top dead center.

8. The multi-link engine as recited in claim 1, wherein the multi-link engine is a variable compression ratio engine configured such that a compression ratio thereof can be changed in accordance with an operating condition by adjusting a position of an eccentric pin of the control shaft; and the upper link, the lower link and the control link are arranged with respect to each other to form a first angle between the imaginary straight line and the horizontal axis when the piston is at top dead center, and to form a second angle between the imaginary straight line and the horizontal axis when the piston is at bottom dead center with both the first and second angles being closer in value when the compression ratio is set lower than when the compression ratio is set higher.

* * * * *